United States Patent [19]

Magnasco et al.

[11] Patent Number: 4,524,801

[45] Date of Patent: Jun. 25, 1985

[54] APPARATUS FOR THE SELECTION, METERING AND DELIVERY OF LIQUIDS, IN PARTICULAR TREATMENT LIQUIDS FOR INDUSTRIAL LAUNDRY WASHERS

[75] Inventors: Enrico Magnasco, Rapallo; Giorgio Viale, Chiavari, both of Italy

[73] Assignee: Colgate-Palmolive Company, New York, N.Y.

[21] Appl. No.: 446,527

[22] Filed: Dec. 3, 1982 (Under 37 CFR 1.47)

[30] Foreign Application Priority Data

Dec. 4, 1981 [IT] Italy ..... 49842 A/81

[51] Int. Cl.[3] ..... F04F 3/00

[52] U.S. Cl. ..... 137/567; 417/138; 417/148; 222/56; 340/624

[58] Field of Search ..... 417/118, 138, 120, 145, 417/148; 137/566, 567, 391; 340/618, 624; 222/56, 64

[56] References Cited

U.S. PATENT DOCUMENTS

| | | | |
|---|---|---|---|
| 355,817 | 1/1887 | Ghegan | 340/624 |
| 3,005,417 | 10/1961 | Swaney | 417/138 |
| 3,435,989 | 4/1969 | Lorenzen | 222/56 |
| 3,556,682 | 1/1971 | Sakamoto et al. | 417/138 |
| 3,602,607 | 8/1971 | Hodges | 417/148 |
| 3,676,019 | 7/1972 | Self | 417/131 |
| 3,826,113 | 7/1974 | Noraas et al. | 137/567 |
| 4,083,661 | 4/1978 | McPherson et al. | 417/138 |
| 4,321,107 | 3/1982 | Gottliebson | 417/129 |

FOREIGN PATENT DOCUMENTS

| | | | |
|---|---|---|---|
| 4097271 | 11/1969 | Japan | 417/138 |
| 0023368 | 2/1980 | Japan | 417/148 |

*Primary Examiner*—A. Michael Chambers

*Attorney, Agent, or Firm*—Herbert S. Sylvester; Murray M. Grill; Norman Blumenkopf

[57] ABSTRACT

A device for the selection, metering and delivery of treatment liquids for industrial laundry washers comprising a plurality of pumping units without positive displacement of pumping members. The pumping action is performed by a correlated combination of applications of pressure and vacuum on columns of the liquid that must be pumped. The delivery or pumping rate may be adjusted by setting on each pumping unit the quantity of the displaced material by sensing the displaced volume.

2 Claims, 4 Drawing Figures

8
9
11
1
2
3
4
10
20
21
22
23
24
7
7'
7''
7'''
6
6'
6''
6'''
16
17
18
19
12
13
14
15

APPARATUS FOR THE SELECTION, METERING AND DELIVERY OF LIQUIDS, IN PARTICULAR TREATMENT LIQUIDS FOR INDUSTRIAL LAUNDRY WASHERS

BACKGROUND OF THE INVENTION

1. Field of the Invention

The present invention relates to a device for the selection, metering and delivery of liquids, in particular treatment liquids for industrial laundry washers.

2. Description of the Prior Art

In industrial laundry washers, opposed from domestic laundry washers, there are used liquid treatment materials, such as detergents, softeners, optical bleaches, disinfectants, rather than such materials in powder form.

Normally, the dosages of these components were prepared manually on volume or weight base and then these were inserted by an operator in the washing machine at selected times of the washing cycles. These systems have the inconvenience of a low dosage precision, need of manpower and dead times.

Recently, automatic metering apparatus have been introduced. The most common of these apparatus includes a series of positive displacement pumps of the membrane type for the delivery of treatment liquids to the washing machine.

Even if these kinds of apparatus provide appreciable advantages with respect to the manual dosing systems, the metering precision is not very high for several reasons; the quantity of liquid that is delivered is controlled by the number of pumping strokes and for each pumping stroke the pumps deliver a constant volume. Consequently, the adjustment of the metering may be made only in discrete steps. Moreover, the number of the pumping strokes is controlled through the operation time of the pump. This means that with liquids having a different density or viscosity, the pumping rate may be modified by the mechanical load imposed by the characteristics of the pumped liquid with a consequence lack of precision in the metering.

It should be remarked that there are available on the market metering pumps that are very sophisticated and that provide a very great precision. There cost is, however, prohibitive for industrial uses of this kind.

The purpose of the present invention is, therefore, the one of providing a device for the selection, metering and delivery of treatment liquids that shows a high metering precision, a very simple principle of operation and low requirements of maintenance and low cost.

SUMMARY OF THE INVENTION

According to the present invention, there is provided a plurality of chambers for the handling of liquid, preferably each one associated to a different component, in connection for sucking and delivering respectively with a tank for the liquid to be metered and the utilizer constituted by an industrial laundry washer, the pumping and metering action being performed by applying a vacuum and pressurized air alternately on one or more of said chambers, the pumped volume being pre-settable for each chamber by sensing the level of ascent and descent of the liquid, under the action of the vacuum and the compressed air, respectively. The unit may be associated to a programmer that performs the counting of the pumping cycles in order to obtain a precise and repeatable information on the quantity of liquid that is delivered to the utilizer such as an industrial laundry washer.

The present invention will now be disclosed with reference to a presented preferred embodiment thereof, referred to as a non-limitative indication and on the basis of the Figures of the attached drawings, wherein:

DETAILED DESCRIPTION OF THE INVENTION

Figure 1:
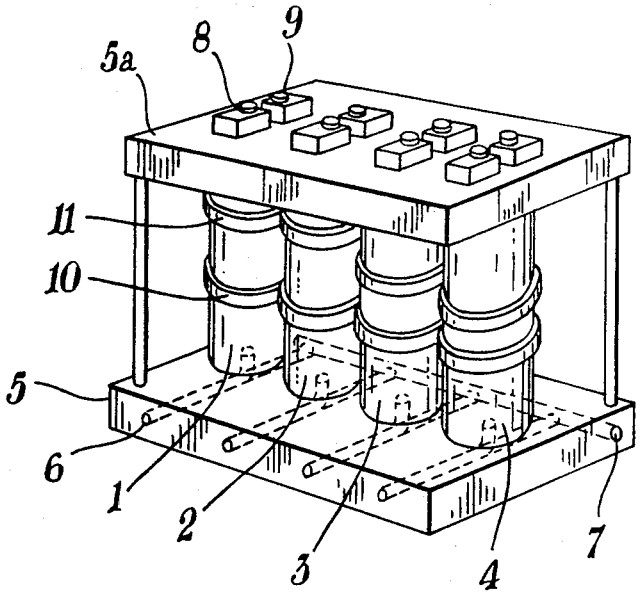
FIG. 1 is an overall, simplified perspective view of a pumping and metering device according to the present invention.

With reference to FIG. 1, in an embodiment referred to only as an example, there is shown a unit comprising four pumping members. As one may see from this figure, four hollow chambers defined by cylindrical members 1, 2, 3, 4 are tightly mounted between a base plate 5 and a head plate 5*a*. In the base plate 5 there are provided channels 6, 7. On the head plate 5*a*, in register with the top ends of the cylindrical members 1, 2, 3, 4, there are arranged electrically controlled valves 8, 9 that control the application of a vacuum or of pressurized air respectively. (Now and in the following reference will be made to pressurized air, clearly in particular arrangements where oxidation is to be avoided in place of pressurized air a pressurized inert gas may be used.)

At a predeterminable height along the cylindrical members 1, 2, 3, 4, there are arranged members 10, 11 for the sensing of the level of the liquid that is handled within the members 1 to 4. The position of the sensing members 10, 11 may be adjusted in height in order to modify in a continuous way the pumping stroke as it will be better explained hereinafter. It is sufficient to say now that the sensing members 10, 11 are arranged for sensing the position of a float sliding within the members 1 to 4 that duplicates in a way that can be sensed the position of the level of the liquid. For a better understanding of the unit let us consider the cylindrical member 1. By applying a vacuum in the interior of the body 1, through the valve 8, there will be a sucking of liquid through the channel 6. Once the vacuum has caused the rise of the liquid in the interior of the cylindrical member 1 up to a level that may be sensed by means of the sensor 11, pressurized air will be applied through the valve 9. The level of the liquid go down because the liquid will be forced into the channel 7. With the descent of the level of the liquid, the level sensor 10 will be activated. At this moment the valve 9 is deenergized and the valve 8 is again energized making the liquid rise again. This operation may be repeated for a desired number of times performing a pumping action without moving members. The unit dose for each pumping cycle may be adjusted by change of the distance along the cylindrical member 1 of the sensors 10, 11 as it is schematically shown on the cylindrical members 3, 4. By means of a control of the energization of the valve similar to the valves 8, 9 arranged in correspondence with cylindrical members 2, 3, 4, four different liquids may be handled. The number of cylindrical members may be selected to conform with particular requirements of a particular installation.

Figure 2:
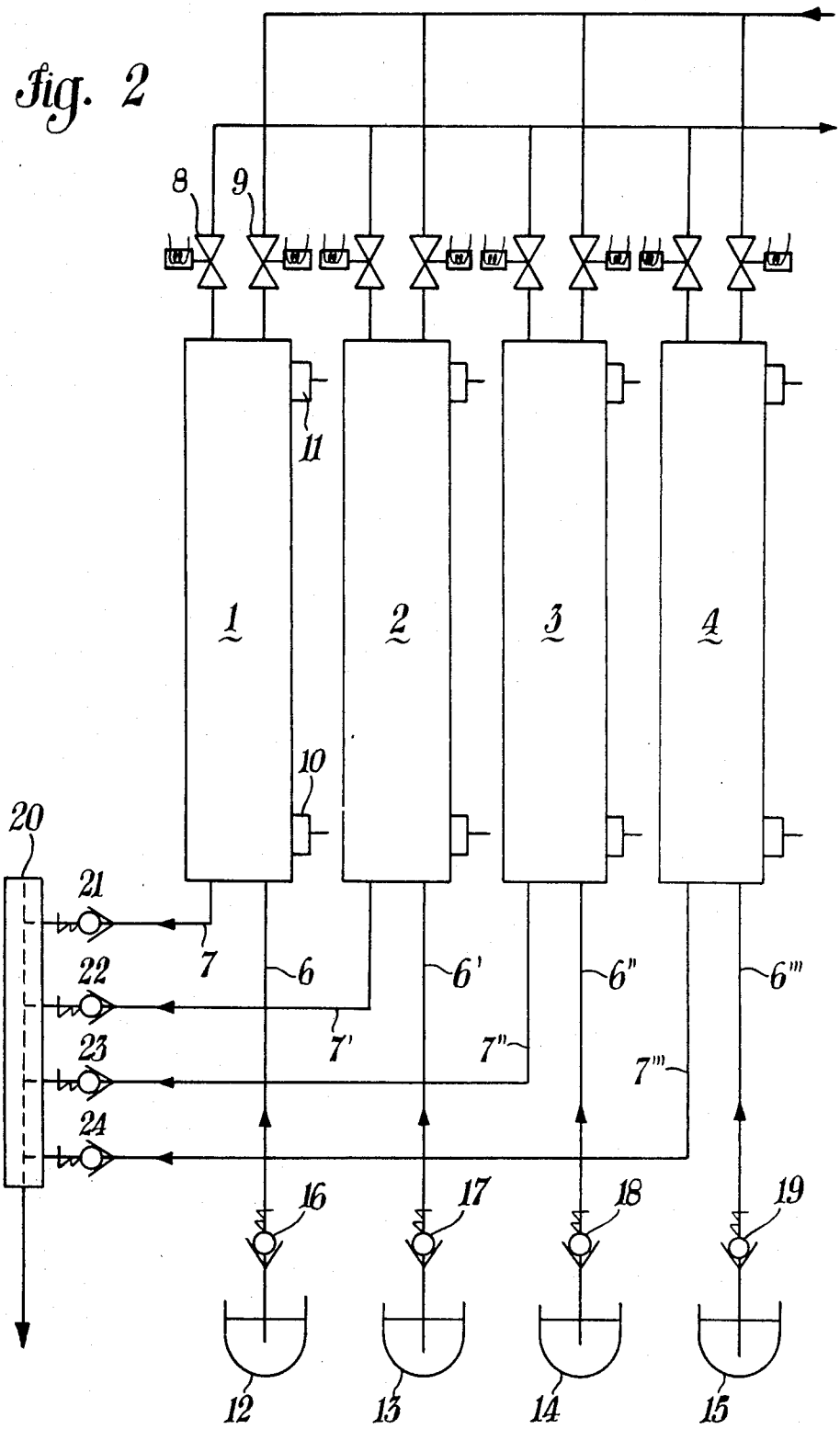
FIG. 2 is a functional schematic diagram of the pumping unit shown in FIG. 1.

This principle of operation may be better understood by making reference to FIG. 2 wherein the same reference numerals utilized in FIG. 1 have been used. As can be seen in FIG. 2, there is schematically shown the tanks 12, 13, 14, 15 of the liquids that have to be handled. The pipes *6, 6', 6'', 6'''* communicate with the tanks 12, 13, 14, 15 through non-return valves 16, 17, 18 and 19. The delivery pipes 7, 7'. 7'', 7''' communicate with a common manifold 20 passed through by water by means of the non-return valves 21, 22, 23, 24.

The several operations of sequential and/or circuital control of the valves 8, 9 that are electrically operated, as well as the similar ones related to the other cylindrical members 2, 3, 4, are controlled as a function of the signals according to the operational changes of the device of the present invention.

Figure 3:
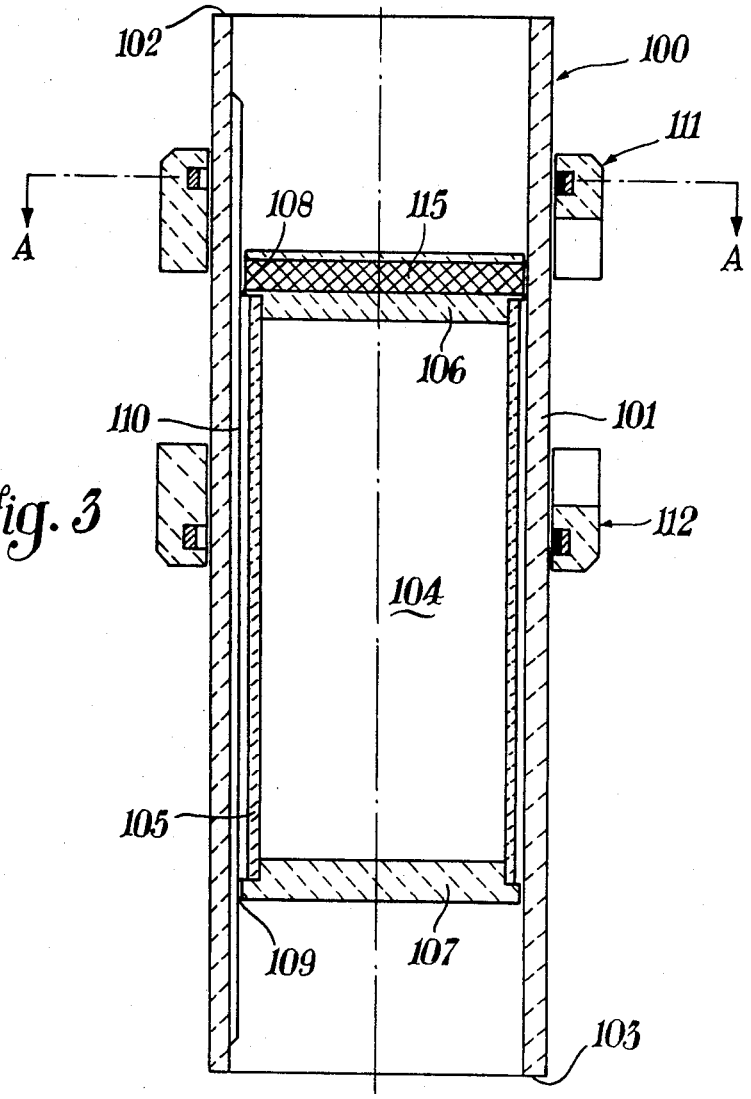
FIG. 3 is a sectional detail view of the structure of one of the pumping units appearing in FIG. 1; and, FIG. 4 is a sectional view of the pumping unit taken along the plane of line A—A in FIG. 3.
Figure 4:
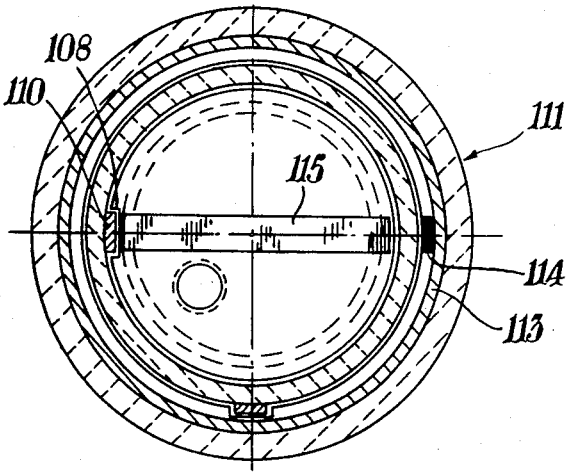

With reference now to FIGS. 3 and 4, the structure of one of the pumping units will be disclosed in detail. One of the pumping details, generally shown in 100, includes a tubular member 101 associated in the head 102 of the electrically controlled valves, not shown, for the application of the vacuum and of the pressurized air and on the base 103 to the channels including the non-return valves for the sucking and delivery of the pumped liquid.

For the above-mentioned reasons, the tubular member 101 is provided with a dielectric material or with a non-ferromagnetic material resistant to the liquid to be handled.

At the interior of the member 101 a floating body, generally shown in 104, may slide, that comprises a portion of tubular member 105 closed at the top and bottom ends with fluid tight closure members 106, 107. The closure members 106, 107 each have a recess 108, 109 respectively for cooperating with a guide member 110 arranged at the interior of the tubular member 101 for preventing a reciprocal rotation between the member 104 and the member 101.

On the external surface of the member 101 there are mounted the level detectors indicated in their whole in 111, 112. The level detection sensors 111, 112 are mounted on the body 101 so that their position in height may be modified at will changing in this way the swing of the liquid to be pumped and consequently the quantity pumped in each cycle of application of vacuum and pressurized air.

In the preferred embodiment, the sensors or level detectors are of a magnetic type using Hall-effect active elements.

The level sensors like the one shown at 111 (the one shown at 112 is identical) include a ferromagnetic ring 113 arranged for concentrating on a Hall-effect magneto-detector 114 commonly available on the market the magnetic lines of flux produced by a permanent magnet 115 housed in one of the closure members 106 of the movable floating body 104.

In this way an electric signal will be available in correspondence with the position of the detector 114.

These signals control with an electronic interface the opening and closure of the valves 8, 9 for the application of vacuum and pressurized air respectively as above disclosed.

It should be clear that the use of an Hall-effect magnetic sensor is given only as an example because a person expert in the art may select other means available in the art for sensing the position of the body 104.

It should be noted that with the pumping system according to the invention relating to the needs of use, the pumping and metering action, at will, may be effected on more than one liquid at the time, possibly with variable ratios, these being useful, for instance, for mixing together interacting liquids having a short stability time once they have been mixed, or for changing the formulations.

It will be noted at this moment that there has been provided a system for pumping and metering liquids with a compact structure virtually devoid of moving parts. This provides a series of advantages that may be immediately appreciated by a person skilled in the art. Moreover, the "infinite" variability of the equivalent of the pumping stroke allows a flexibility of operation unknown with other positive displacement pumping systems.

What is claimed is:

1. A device for selecting, metering and delivering treatment liquid to an industrial washer comprising a plurality of chambers, a plurality of tanks of treatment liquid, each tank being respectively connected to one of said chambers, means for sucking liquid from said tanks and for delivering said liquid to the respective chamber, said means including means for applying a vacuum on said tanks to suck the liquid and further including means for applying pressure on said sucked liquid to force it into said respective chamber, and control means for controlling the volume of each liquid delivered to its respective chamber, said control means comprising means for sensing the level of rise and descent of the liquid in said chambers, said means comprising a floating member on the liquid operatively associated with sensors of the instantaneous position of said floating member correlated with the level of the liquid, the control of the application of said vacuum and said pressure being performed under the control of the rise level of each liquid to be handled.

2. A device according to claim 1, wherein the proximity detector cooperates with a magnet associated to a float arranged in the interior of said handling chambers.

* * * * *